US005740635A

United States Patent [19]

Gil et al.

[11] Patent Number: 5,740,635

[45] Date of Patent: Apr. 21, 1998

[54] ENCLOSURE FIRE-RESISTIVE FOR A PREDETERMINED TIME

[76] Inventors: Maria Desamparados Mateu Gil; Beatriz Mateu Gil; Lorena Mateu Gil, all of Calle San Vicente, 22, Valencia, Spain

[21] Appl. No.: 771,218

[22] Filed: Dec. 19, 1996

[51] Int. Cl.[6] ..... E04B 2/02

[52] U.S. Cl. ..... 52/79.1; 52/232; 52/380; 52/381; 52/382; 52/383; 109/82; 109/84; 109/80

[58] Field of Search ..... 109/80, 82, 84; 52/232, 79.1, 380–383

[56] References Cited

U.S. PATENT DOCUMENTS

| | | | |
|---|---|---|---|
| 3,623,934 | 11/1971 | Madou | 161/89 X |
| 3,934,066 | 1/1976 | Murch | 117/137 |
| 4,179,535 | 12/1979 | Kalbskopf et al. | 427/206 |
| 4,276,332 | 6/1981 | Castle | 52/232 X |
| 4,470,357 | 9/1984 | Sanzaro | 109/84 |
| 4,485,601 | 12/1984 | De Boel | 52/232 |
| 4,574,454 | 3/1986 | Dyson | 52/232 X |
| 4,741,276 | 5/1988 | Pollock | 109/82 X |
| 5,088,249 | 2/1992 | Marzouki | 52/232 |
| 5,257,583 | 11/1993 | Koenig | 109/84 X |
| 5,469,796 | 11/1995 | Koenig | 109/84 X |
| 5,496,640 | 3/1996 | Bolton et al. | 52/232 X |

*Primary Examiner*—Wynn E. Wood
*Attorney, Agent, or Firm*—Harrison & Egbert

[57] ABSTRACT

An enclosure that is fire-resistive for a predetermined period of time including a floor having a structural forging which is covered with a glass wool felt. A platform of wooden plates is affixed to the glass wool felt. Lateral expansion joints are positioned at ends of the wooden plates. A wooden skirting board is positioned over the expansion joints and resides against walls of the enclosure. The walls are formed by plywood boards, incombustible boards, and a wooden board formed by planks. A metallic square bar is affixed to the floor and resides at the bottom of the walls. A ceiling is self-supported at the top of the walls.

10 Claims, 7 Drawing Sheets

ENCLOSURE FIRE-RESISTIVE FOR A PREDETERMINED TIME

TECHNICAL FIELD

The present invention relates to a new enclosure fire-resistive for a predetermined time. The purpose is to resist the fire for a determined period of time so as to keep adequate conditions until the arrival of the fire service. The people and materials stay within the enclosure. The enclosure retains its shape and resistance during the fire. The enclosure is capable of being installed inside a building, or on a mobile structure, such as a ship. The enclosure has doors which, according to their characteristics, allow the inner area to maintain adequate conditions for a predetermined period of time.

This invention finds its application in the field of the manufacture of fire-resistant structures.

BACKGROUND ART

In principle, all the materials used in the manufacture of enclosures or dwellings being qualified to resist fire during predetermined period of time must meet a series of particular requirements. These requirements include stability, resistance, insulation and lack of toxicity.

With regard to stability, all the materials should behave in a stable way in the presence of a fire, that is to say, they should not lose the mechanical features that existed before the existence of a fire.

In relation to resistance, the materials should have a high flame and fire resistance. With regard to insulation, the materials used must be heat insulating.

Lastly, as for toxicity, these materials should not give off, at any moment, toxic or inflammable gases, even during the combustion.

Up till now, it has been thought that those materials presenting the above mentioned conditions are conventional incombustible materials. This assumes that their incombustibleness can eliminate any danger in case of a fire.

Nevertheless, it has been proved that the characteristics of the above mentioned materials are not accurate, since for a building material to provide safety in the presence of a fire, it is very important that it retains, in an essential way, its shape and resistance in the fire, relying on a thermal conductivity which is markedly low.

A material having these conditions is, undoubtedly, preferred to another material which may not burn, but loses its resistance quickly when submitted to the action of fire.

This reasoning is based on the fact that, in a building construction, the function of the materials is to support it and, consequently, to create a space to be used as a room, warehouse, etc. If they still maintain this function, even in case of a fire, they are valid, even if they can burn.

On the other hand, if they own these properties, they will allow the persons and materials protected by them to be more easily saved, and also they will permit to go into action the fire extinguishing system existing in the enclosure.

By way of example, it can be asserted that, at present, firemen do prefer to intervene in a fire with wooden stairs and structures than in a building having mechanical stairs and structures or with masonry works. In the first case, firemen can take preventive measures, knowing the ground on which they are acting. In the other two latter cases, the materials, when heated by the fire action, make the transit difficult, they crack open and collapse without warning.

Consequently, wood is proving to be, at present, one of the most adequate materials to control a fire.

Wood is one of the materials better combining the above mentioned four qualities, namely: stability, resistance, insulation and lack of toxicity. Nevertheless, the downtrend in using wood in the building industry has been due, mostly, to the poor quality of the material used.

Also, the inadequate application of wood, often discredited by many builders, has had an influence on the lack of utilization of same. Nevertheless, the introduction of new technologies and new materials allows a harmonic conjunction of same, creating the appearance of a new product, which, used in an adequate way, can act preventing a fire. It also provides valuable time for saving both persons and materials protected by same, allowing for the fire extinguishing system to be put in action.

Obviously, the use of wood as a material for building or manufacturing fire-resistive enclosures must rely on a greater resistance, both as regard the flexion and the compression, a annulment and reduction of thermal conductivity and expansion, and, at the same time, a reduction and annulment of dimensional variations, that is to say, contractions and expansions.

It should be pointed out that, in an axial sense, the dimensional variations of wood, in parallel to the fibers, and under the effect of the humidity changes, are practically null.

Also, the wood used must improve both inertia and its mechanical characteristics. Its temperature must be constant. This allows the assembly of different parts, both if they are bonded by gluing, and by using nails, screws, pegs, etc.

The above mentioned method for building fire-resistive enclosure can be also applied to access doors or to doors installed in dwellings, which must meet the mentioned characteristics.

Nevertheless, until now, nothing is known about the existence of a new enclosure fire-resistive for a predetermined period of time, fitted with doors also fire-resistive, the material of which, used in a basic manner, is wood.

SUMMARY OF THE INVENTION

The new enclosure fire-resistive for a predetermined time, as proposed by the invention, is novel in the field of application to which it is incorporated. Using a wood fitted with the adequate characteristics, allows the persons and materials protected within the enclosure to be saved with the aid of doors, and at the same time, it manages to expand the time available for fire extinguishing services in the enclosure to arrive.

In a most definite way, the new fire-resistive enclosure for a predetermined time is constituted starting from the following elements. These elements include floor, walls, ceiling, doors and windows.

The floor or walking flooring will be supported or sustained on a forging or structural element used. It will be composed of a glass wool felt, or similar product, classified as incombustible. Also, the floor will have a parquet or platform composed of several sheets of wood glued to one another and treated with ignifuge and intumescent products. The floor will have an appropriate expanding joint, and the wooden skirting boards. Any other type of natural or synthetic flooring can be used, provided that it combines the four conditions of stability, resistance, insulation and lack of toxicity in the presence of a fire.

The vertical walls or ornaments will be adorned with decorations on single face, forming a sandwich, and being composed of fiber or agglomerated plywood boards, subject to an ignifugation treatment. The board is decorated on one of its faces. This face is fully smooth and treated with plates, sheets or natural or synthetic paintings, or presenting the corresponding raised work by means of wood, agglomerate or similar mouldings.

The board can be also constituted as an incombustible board, made on the basis of gypsum, alabaster or fibrosilicates. It can be fully flat or embossed, and decorated in the same manner as that above mentioned.

The walls will mount also on an incombustible board, glued, screwed down or nailed, or with several of these combined systems, on the anterior board. This incombustible board will be composed or manufactured by using gypsum, alabaster, fibrosilicates or any other product classified as incombustible and having an adequate thickness.

The invention uses the portion corresponding to the walls on other wooden board composed or formed of planks or small planks glued one other. This woo relies on the same or different to that used in the invention, relying on the same or different densities, and fulfills, in a total and absolute way, the requirements having a predeterminate thickness. The latter wooden board will be treated on both faces with the other ornamental and incombustible boards, in order to compensate for the stresses or strains which could cause twists, fissures or warpings. Also, this latter board will be the core or framework of the sandwich, decorated on a sole face. This letter board will be vertically fastened one, to another, by using known procedures or systems, such as grooves, tongues or dovetails.

Horizontally, at its lower part, on the floor, this board will be fitted with a protuberance having a "U"-shape, inside which, a metal or wooden square bar will be housed, fixed to the floor or structural forging, by means of conventional screws, nails, glue or welding. In both cases, this square bar, either metallic, or wooden, will house inside it intumescent products or pastes which will act at a predetermined temperature. As for the upper part, the boards will be fastened by means of a reversed "U" embracing the boards of the all ornament or gap. This reversed "U" is made of a metallic plate or any other similar and adequate product. If it is a metal plate, it will be treated against rusting and against any other damaging agent. These boards will be designed with widths, one being multiple of others, covering any gap. All the boards will be fitted, at their grooves, dovetails or bonding tongues, both horizontal and vertical, throughout their perimeter, with intumescents products strategically placed at the joints or bondings, and inserted into the wood. These appear at calculated and predetermined temperatures beforehand, in order to impede, hamper and obstruct the action of the fire. Also, throughout their perimeter, the boards will be insulated through acoustic devices.

The ceilings or the false ceilings will be made self-supporting. They will be formed from an exposed strip made of noble wood, agglomerate or fiber, covered with a natural or synthetic plate. This strip will be moulded and fitted with a groove which will support a polygonal shaped box, inside which a thermically and acoustically insulated filter or glass blanket will be housed. This box or case is fitted throughout its perimeter and the edges with both intumescent tapes ready to act in the presence of heat. The intumescent tapes are inserted into splits made at the sides of the box for this purpose. Each of these boxes are screwed, glued or nailed at their four corners, with a neoprene, synthetic rubber, P.V.C. or similar gasket, in order to provide a high watertightness. On the noble wood strip, a balancing strip will be glued. This strip can be made of conventional wood, agglomerate, dovetail, fibers or similar materials. This third strip has a reverse "T" shape, and relies on a greater stiffness in order to avoid, at the same time, twists and warps, since it is screwed at its upper part by using a fastening system.

It should be pointed out that the strips will be bonded to one other by means of known half wood bondings, but supported on vertical ornaments, also known as partitions. The strips will form symmetrical polygons to act as registers. This gives access to the false ceiling or roof. It will be formed with fire retardant and incombustible ornamental materials, as well as with intumescent products, strategically arranged on the gaskets in order to prevent and impede the action of fire. The exposed portion of these registers, like cases or boxes, will be configured by means of ornamental plates, either natural or synthetic, glued on fire retardant and incombustible boards, containing fireproof mineral wool felts. These registers will be fastened by means of conventional systems to half-wood interlaced bolsters or crosspieces, as above mentioned.

In a first embodiment, the doors can be formed from a bore or supporting structural element. This is formed starting from a wooden board, fully coated, and using plates or sheets of a fireproof material. In turn, the door will be fitted with a fire retardant board to be hidden by means of a decorative plate, if desired, which can be made of different materials and presents different ornamentations, according to the purpose of the door in question. These items can be a wooden plate, a stratified board, a plastic methacrylate sheet, or similar, materials. These external elements can be fitted with an adequate treatment, such as, for example, painting, polishing, varnishing or enameling. The door has a wooden perimeter edge having inside a plurality of intumescent tapes, arranged in specific points to carry out a predetermined function. The door has a frame, adequately arranged, and, also, has appropriate iron fittings.

The door can have different thicknesses, and according to its specific configuration, it will allow the fire to act for a greater or lesser time. This application is effected to the doors and to the windows, for which both the frames, cases, and the leaves will be made of fire retardant wood and intumescent putties, pastes or tapes, on which glasses prepared for withstanding high temperatures will be installed.

The purpose of the invention is to protect the wood from a fire, as well as all good heat-conductive elements by means of intumescent products or tapes so that a fire cannot be produced by heat transmission.

BRIEF DESCRIPTION OF THE DRAWINGS

In order to complement this description and to aid to a better understanding of the characteristics of the invention, the appending drawings, which are a part of this specification, show, by way of illustrative and non-limiting example, the following figures.

DETAILED DESCRIPTION OF THE PREFERRED EMBODIMENTS

Figure 1:
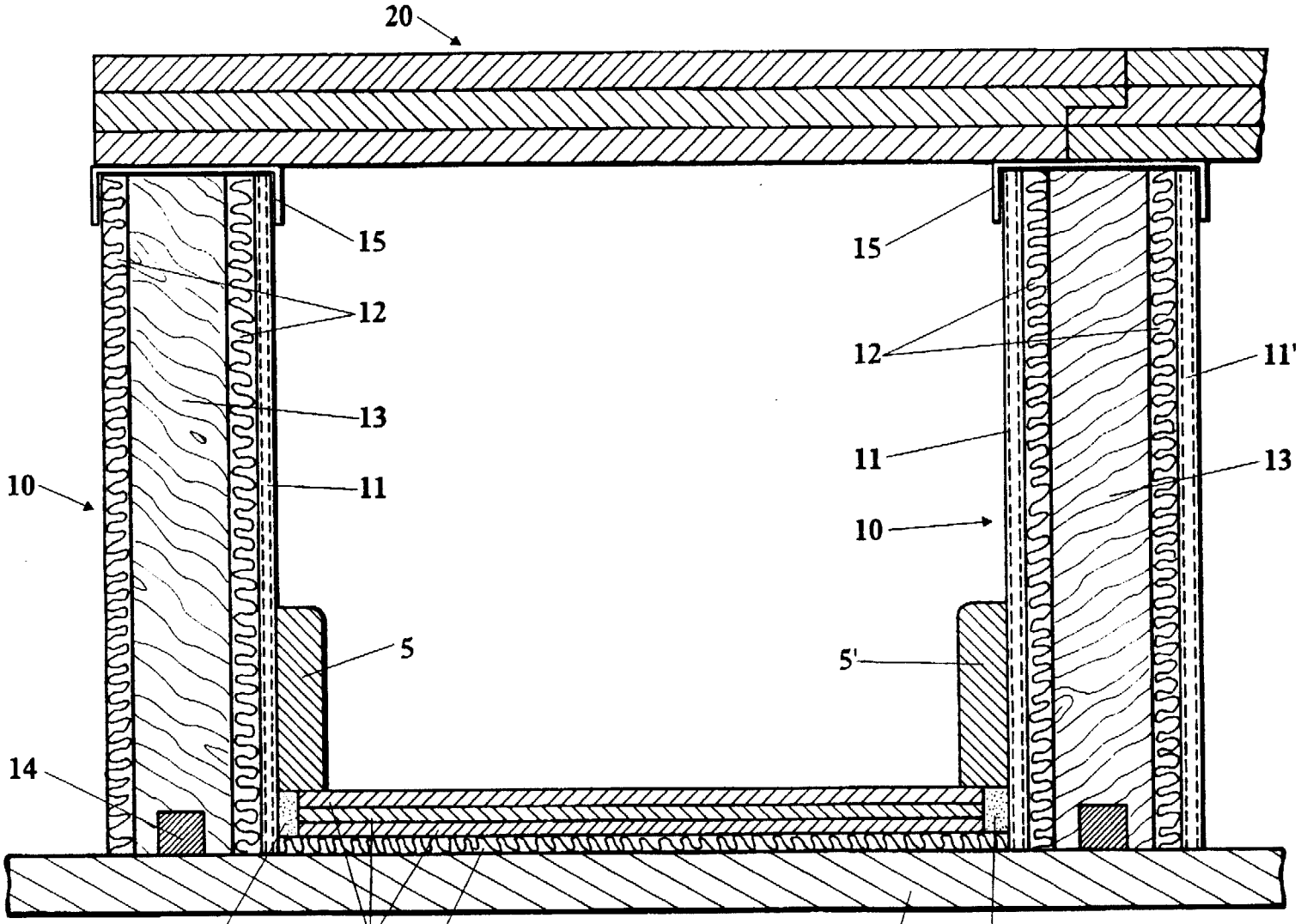
FIG. 1 shows a side elevational view, duly sectioned, of the invention of a new enclosure fire-resistive for a predetermined time.
Figure 2:
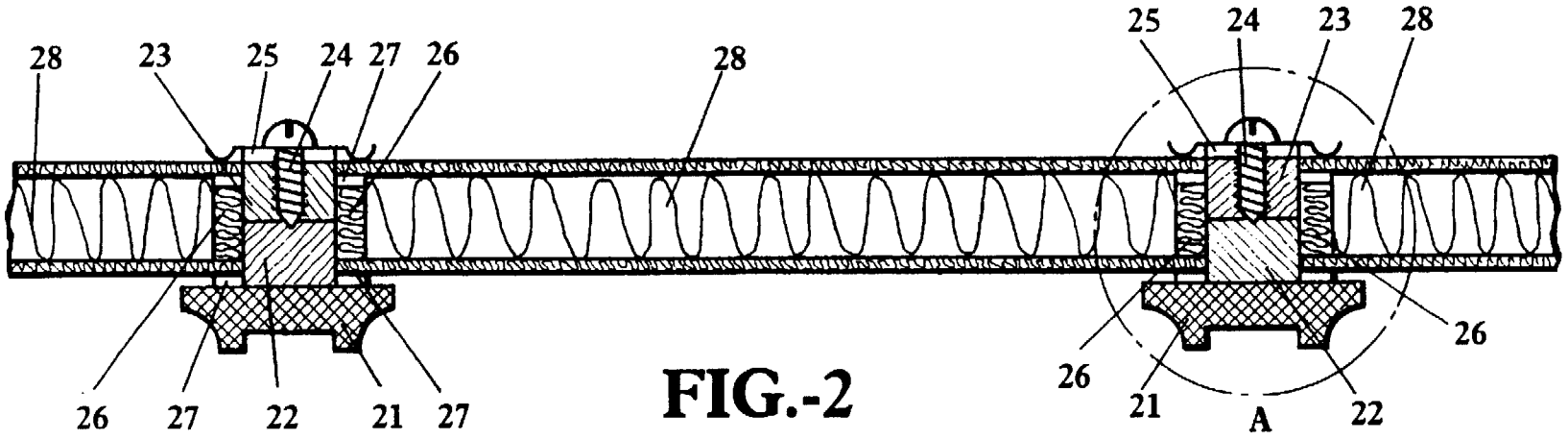
FIG. 2 shows a side elevational view, also sectioned, of the ceiling.
Figure 4:
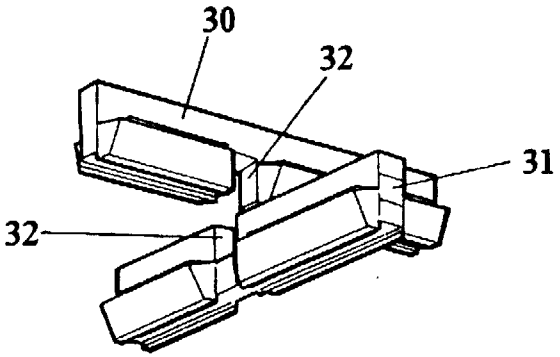
FIG. 4 shows the manner in which the external ornamental parts of the ceiling are bonded-at half-wood.
Figure 3:
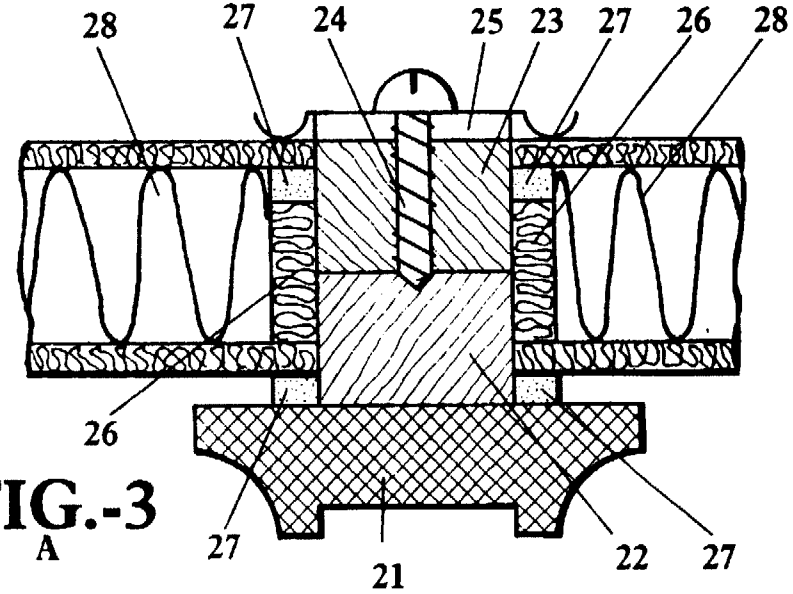
FIG. 3 corresponds to a detail on the bonding of the object shown in FIG. 2.
Figure 5:
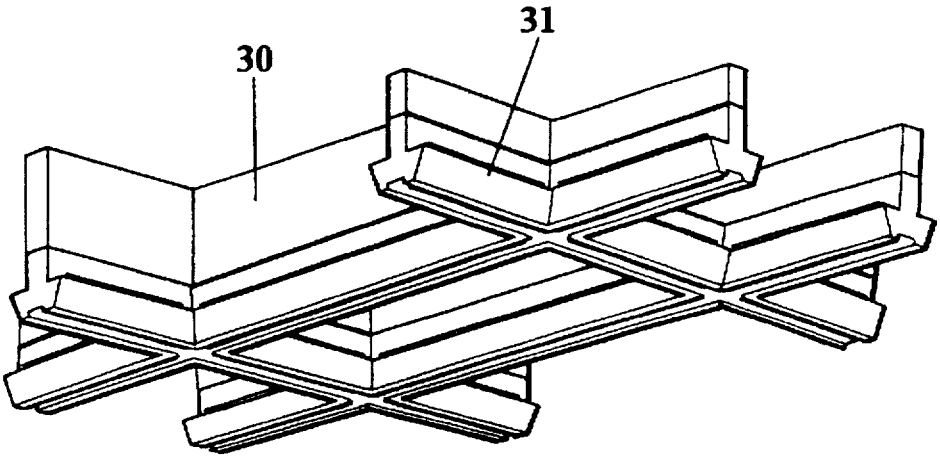
FIG. 5 corresponds to a perspective view on the final disposition of the ornamental elements composing the ceiling, bonded at half-wood, schematically represented in FIG. 4.
Figure 6:
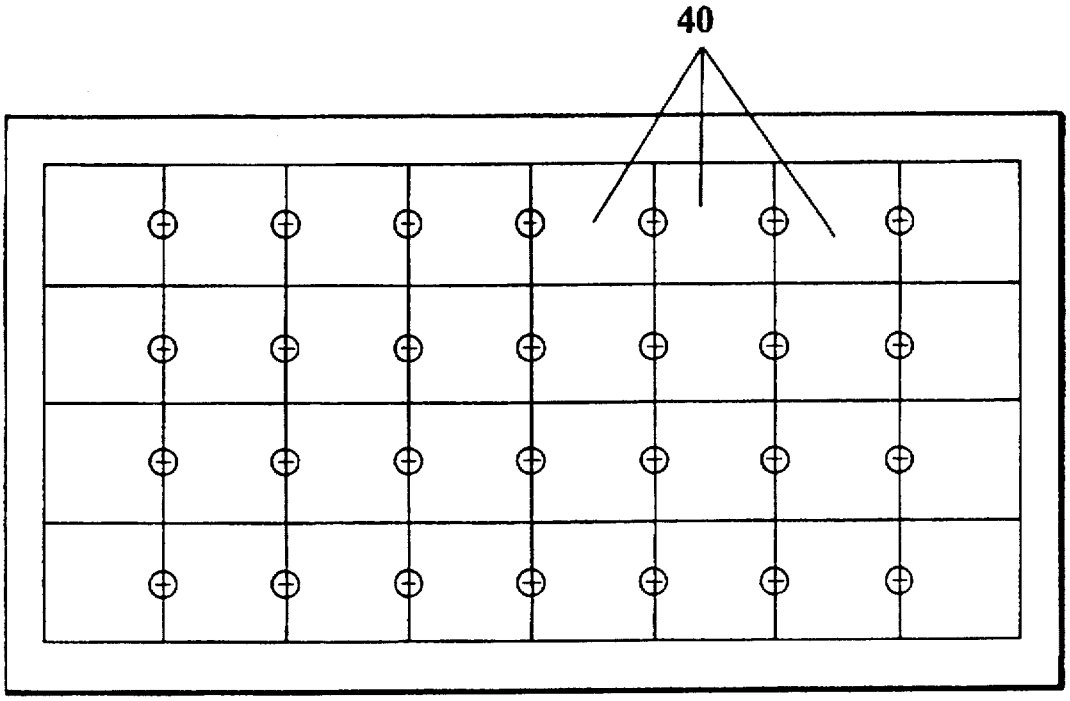
FIG. 6 shows a plan view at the upper part of the object of the invention.
Figure 7:
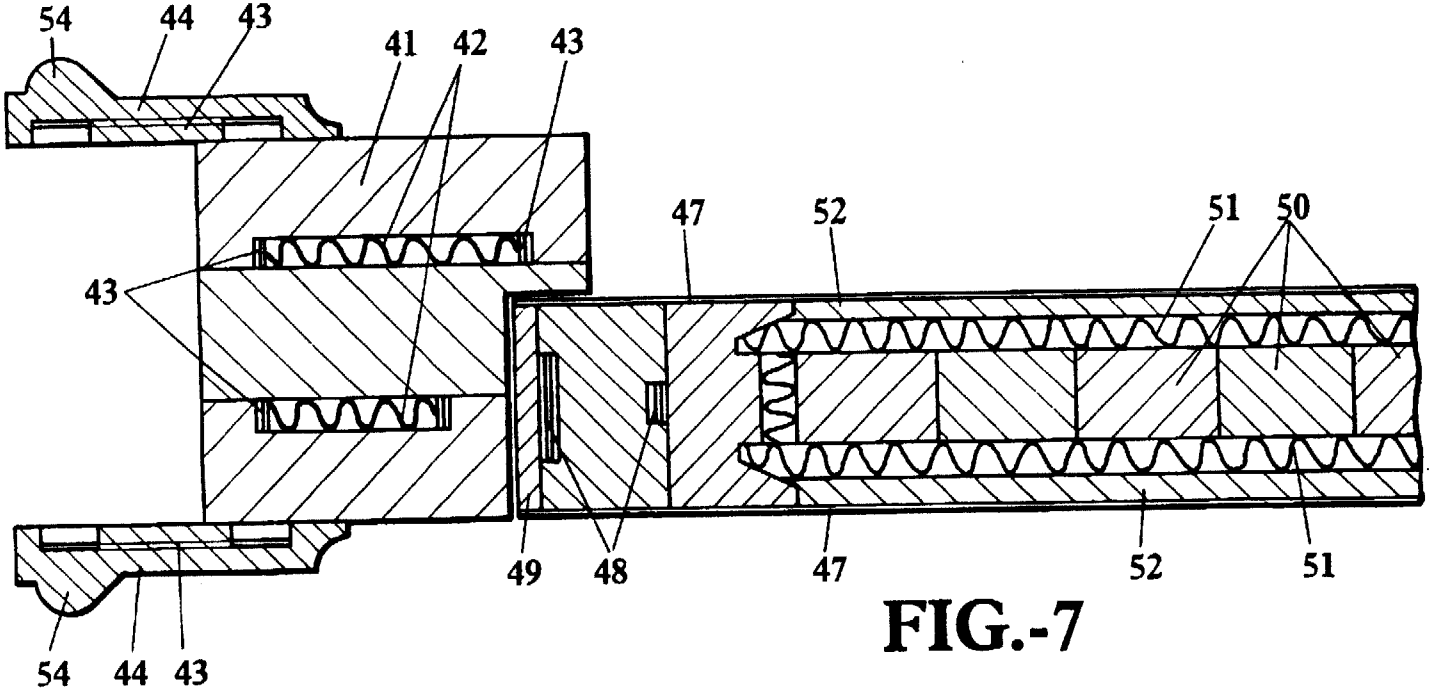
FIG. 7 shows a sectioned view of the doors and windows of the invention, configured without mouldings.
Figure 8:
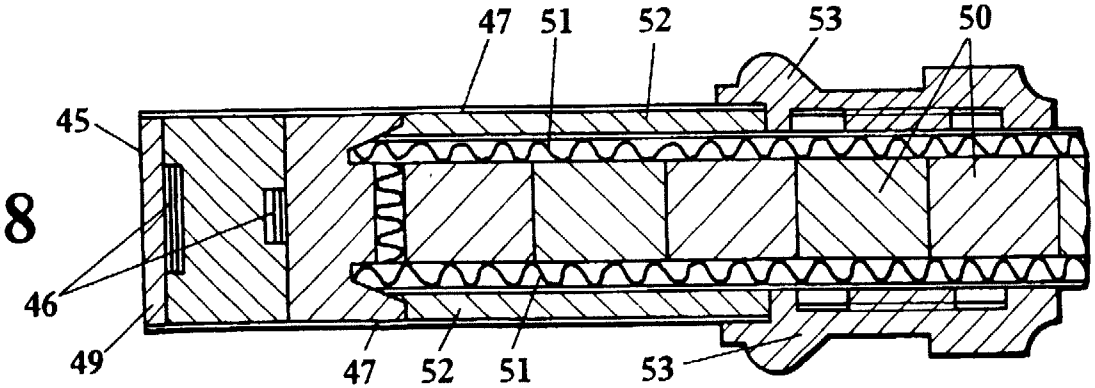
FIG. 8 shows a similar view of the object represented in FIG. 7, but with mouldings.
Figure 9:
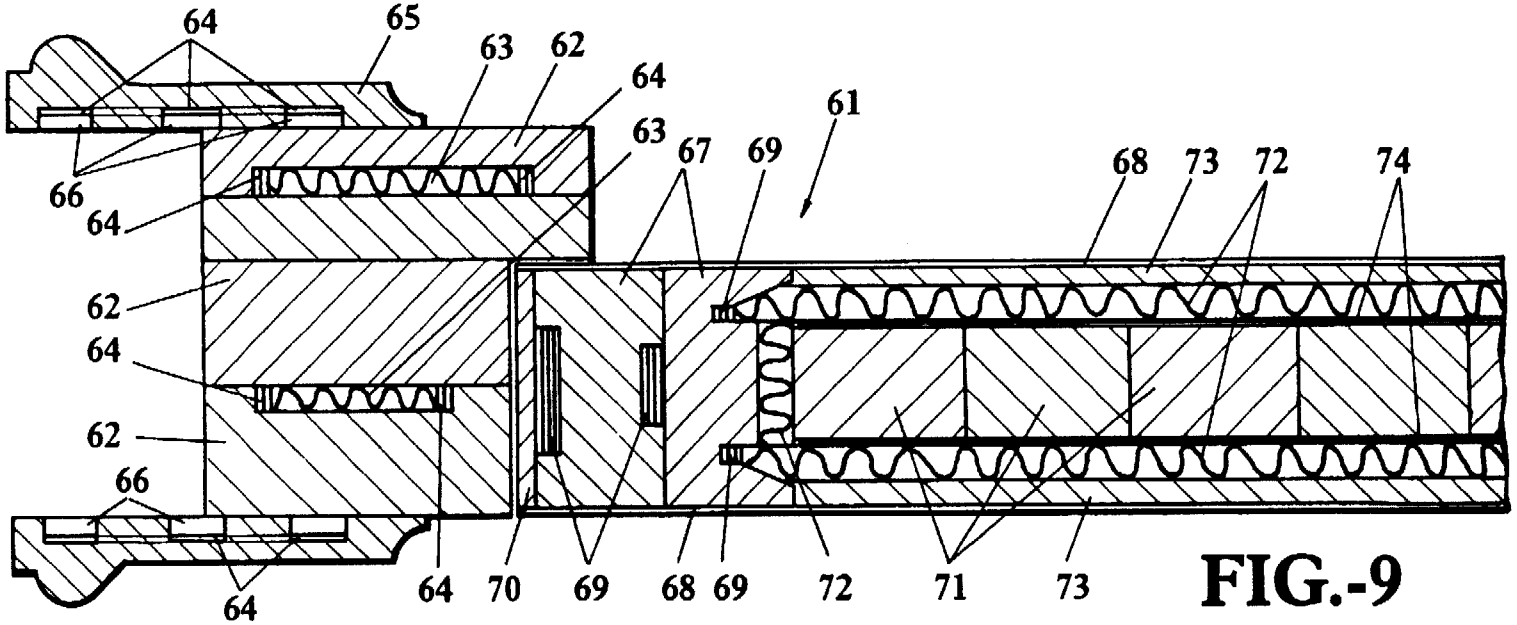
FIG. 9 shows a sectioned view of a second embodiment of the object represented in FIGS. 7 and 8, a showing a section of the frame and joint covering appearing in this figure.
Figure 10:
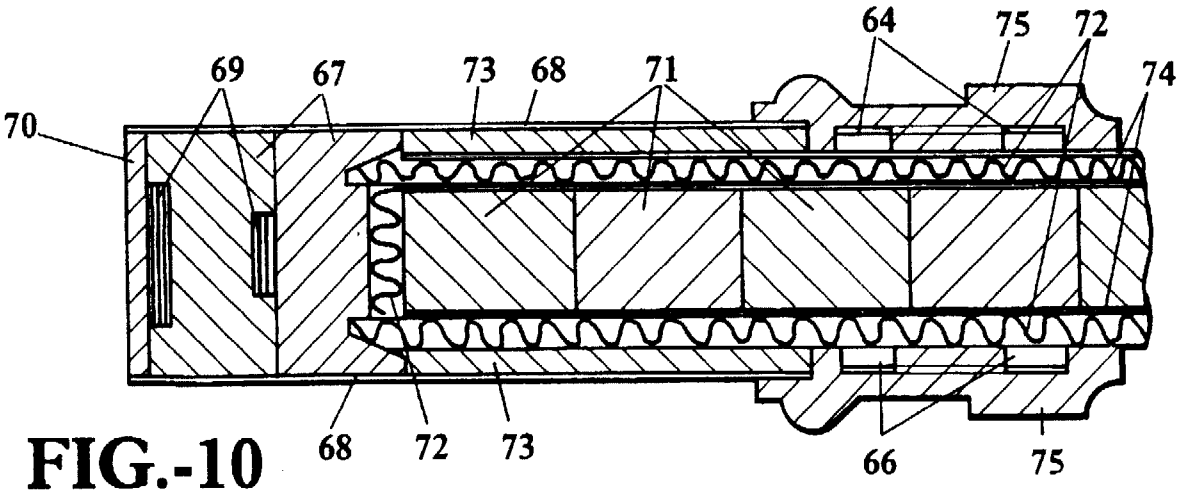
FIG. 10 corresponds to a similar view to that represented in FIG. 9, with mouldings.
Figure 11:
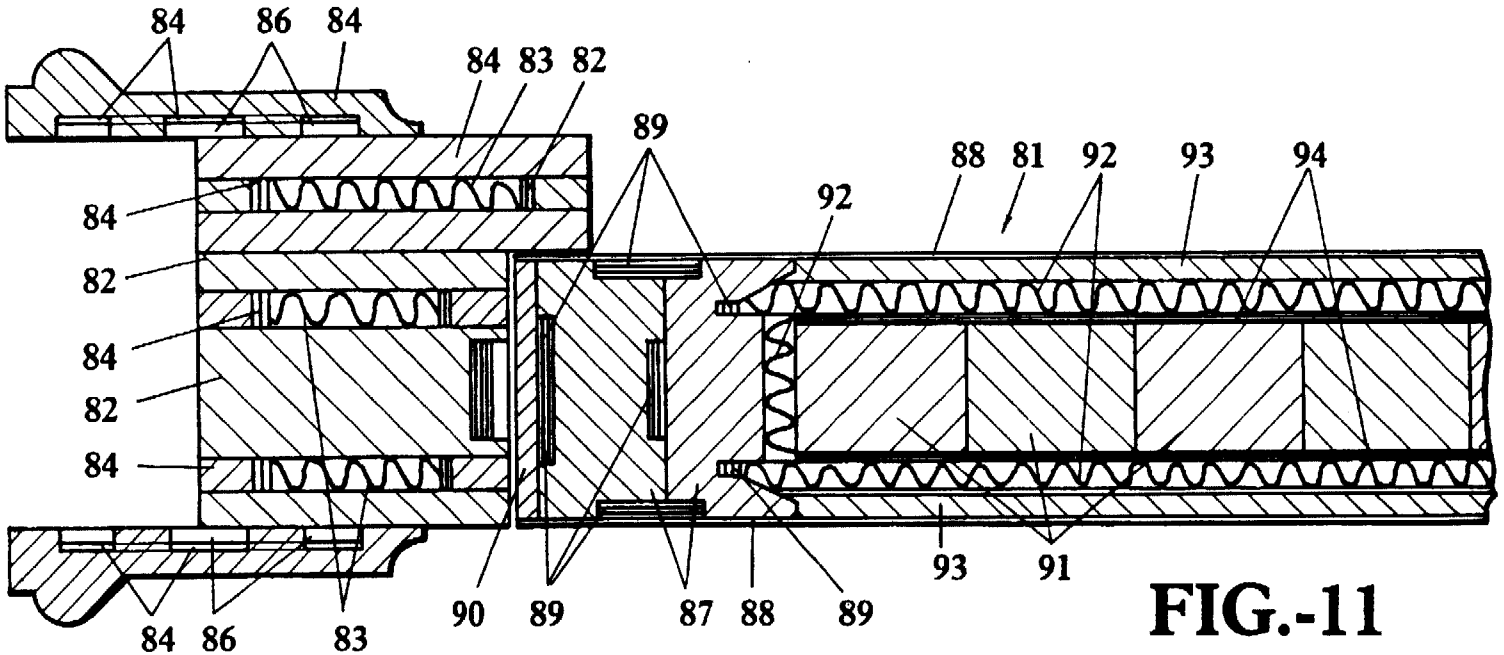
FIG. 11 corresponds to a third embodiment of the doors of the invention, showing also a section of the frame and joint covering.
Figure 12:
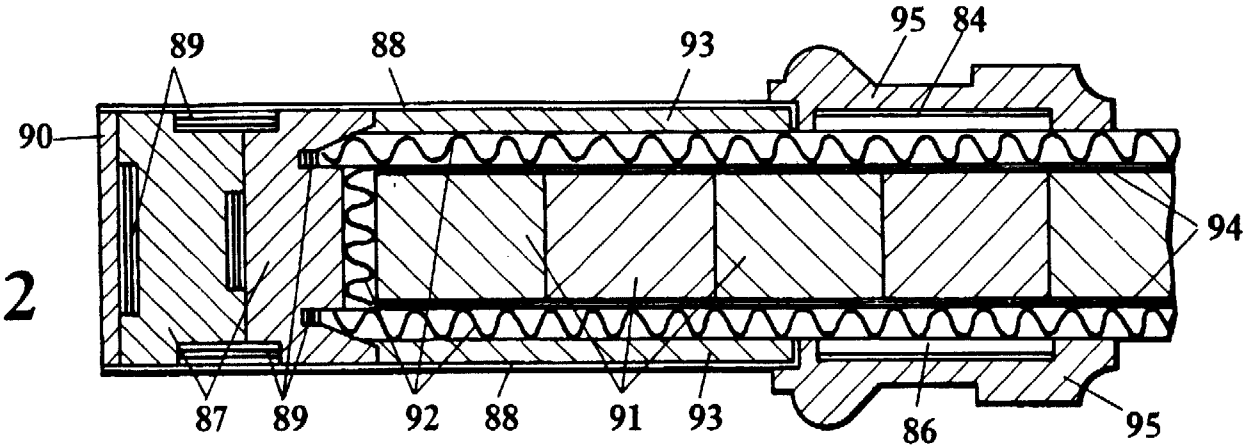
FIG. 12 corresponds again to a view of the object represented in FIG. 11, with mouldings.
Figure 13:
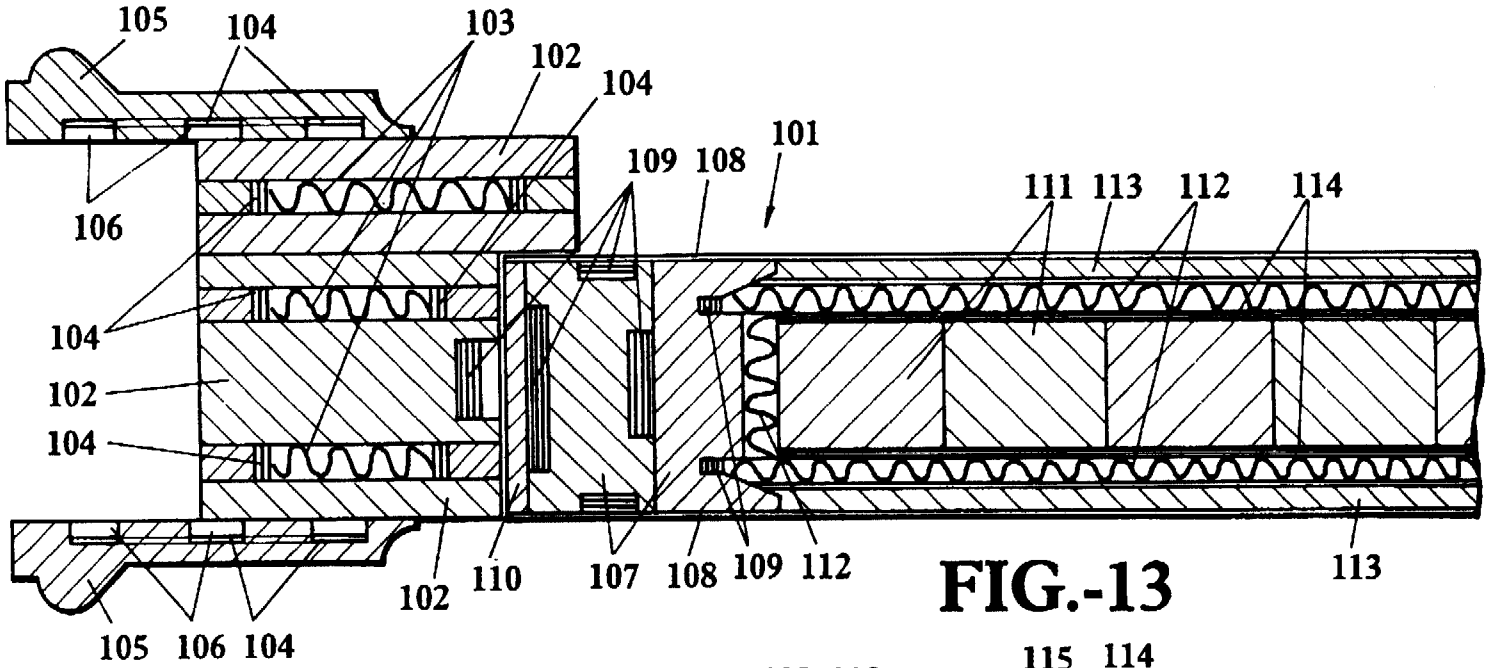
FIG. 13 shows a fourth embodiment of the object of the invention related to doors and windows, without mouldings.
Figure 14:
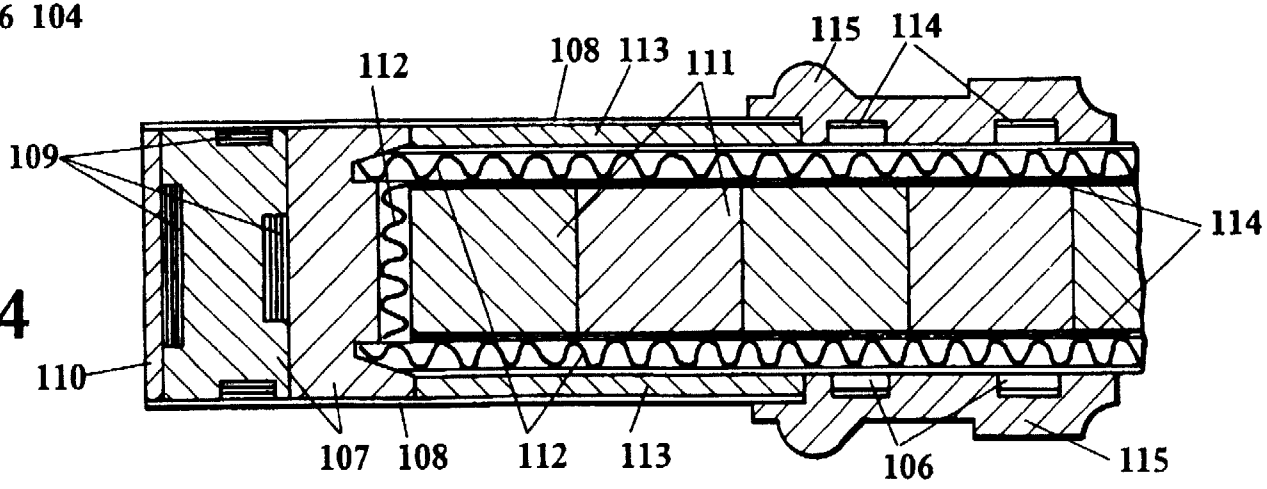
FIG. 14 shows, again, the embodiment represented in FIG. 13, with mouldings.

From the FIGS. 1 through 6, it can be seen that the new fire-resistive enclosure is formed from a floor supported on a forging 1, covered by glass wood felt 2, or a similar incombustible product, and on which a parquet or platform 3 is installed. The platform 3 is composed of several layers of wood glued one to another, and treated with fire-retardant and intumescent products. The sides of the platform or parquet are composed of a wood sheet 3, with expansion joints 4 and 4', and on which wood skirting boards 5 and 5' are incorporated.

As above mentioned, any type of natural or synthetic floor will be suitable, provided that it meets the conditions of resistance in the presence of a fire.

The walls 10 or vertical partitions decorated on one face, forming a sandwich, are formed by a plywood board 11, agglomerated or of fibers, subject to a fire-retardant treatment. The board can be incombustible, made of gypsum, alabaster or fibrosilicates, flat or embossed, and decorated, with or without mouldings. The walls or vertical partitions include a screwed, nailed or glued incombustible board 12, or with several of these systems, combined on the board 11. This incombustible board 12 can be composed of gypsums, alabasters, fibrosilicates or any other product classified as incombustible. The walls 13 have a board which can be of two types. First, the board can be a wood board composed or formed by planks or small planks glued one to another of the same wood or of different woods, of same or different thickness, and with a predetermine density. Secondly, the board will be formed by a frame made of wood, hollow inside. This void is filled by boards made of fiber agglomerates or similar fire-resistant materials, as well as by means of fiber or wool felts, or similar materials, insulating both thermically and acoustically. The wooden board 13 will be treated, on both faces, with the boards 11 and 12, decorative and incombustible, respectively, in order to compensate for the stresses and strains that can cause twists, fissures or warps. The board 13, if composed of planks or small planks, will be configured as the core or framework of the sandwich 10. It can be decorated on one face. It will be vertically fastened, one to another, by using different groove, tongue or dovetail systems.

Horizontally, at the lower part, in the floor, this board will carry, a protuberance adopting a "U" shape, to house inside a square 14 made of a metallic or wooden material, to be fastened to the forged or structural floor 1 by screwing, nailing, gluing or welding. In both cases, this square bar, both metallic and wooden, will house intumescent products or pastes.

As for the upper part, the boards 11, 12 and 13 will be fastened by means of a reverse "U" 15, the boards of a whole partition or void. This part 15 is made of a metallic plate or any other similar product. If metallic, it is treated against the rust or against any damaging agent. The boards 11, 12 and 13 will have adequate widths in measures which are multiples, one to another, to cover any void.

All the boards will have at their grooves, dovetails or bonding tongues, both horizontal and vertical throughout their perimeter, both thermal and acoustic joints, as well as intumescent products, strategically arranged on the joints or bondings, and inserted into the wood to appear at calculated and predetermined temperatures so as to impede, obstruct and hinder the fire action.

The, ceilings 20 will be self supporting. They are formed from an exposed strip 21, made of noble wood, agglomerate or fibers, coated with natural or synthetic sheet, which will be moulded and fitted with a groove on which a polygonal box will be supported. Inside, an isolated thermal and acoustic glass felt or blanket 28 will be housed. This box is fitted throughout its perimeter, and both edges, upper and lower, with intumescent tapes 27 adequately prepared to act against the heat action. These intumescent tapes 27 will be inserted into splits made on sides of the box 25. Each box will be screwed, glued or nail mounted, at the four corners, with a neoprene, synthetic rubber, P.V.C. or similar gasket, to provide a high watertightness. On the noble wood strip 21, another balancing strip 22 will be glued. The strip 22 is made of conventional wood, agglomerate or plywood, of fiber or similar, which is glued to a third strip 23. It will provide the whole reversed "T" profile with a greater stiffness, avoiding, at the same time, twists and warps. It is screwed, at the upper part, to the fastening system 24 and 25.

The ceiling will be adorned with strips 3 and 31, bonded at half-wood 32, forming symmetrical polygons one to another. These act as registers so as to give an access to the false ceiling or roof. They will be formed with fire-resistant and incombustible decorative materials, with intumescent products strategically arranged in the joints to hinder or impede the fire action. The exposed portion of these registers, configured as a box 40, will be formed by decorative natural or synthetical sheets, glued on fire-resistant and incombustible boards which contain mineral wool felts, which are incombustible. These registers will be fastened by conventional systems to interlaced bolster or crosspieces at half-wood, as already mentioned.

The doors and windows can of several configurations, in order to obtain a greater or lesser fire resistance. These doors and windows are formed by means of frames and frameworks, with the cooperation of intumescent pastes or tapes, on which glasses prepared for withstanding very high temperatures will be installed.

In a first embodiment, the doors of the invention will be formed from a wooden support 41 having an incombustible board 42 and an intumescent tape 43 having wood, agglomerate 35 or fiber zones 44, and a strip or wooden sheet 45, as an intumescent tape protector.

In the leaf, there is a frame having a wooden support 46, a wooden plate 47, an intumescent tape 48 and a wooden strip or plate 49 acting as a protector for the intumescent tape. A wooden structural support 50, an incombustible board 51, a fire-resistant board 52, a wooden plate 47 having a joint covering 54 and mouldings 53 which can be incorporated on the panel.

The door relies on a wooden board fitted with plates of an incombustible material, so as to protect each of the board sides. The door is insulated from the exterior, and, consequently, from a possible fire extension by using fire-resistant boards and decorative plates, all made of adequate materials, and treated by means of conventional procedures. A perimetric wooden edge has been provided which incorporates intumescent tapes and a continuous wooden plate protecting the intumescent tape. The frame of the door of this first embodiment, is composed of a core of wood including incombustible plates and intumescent tapes, as already mentioned.

In a second embodiment, the door 61 can be formed from a wooden support 62, formed by four strips which are bonded one to another. Between each pair of strips 62, is an incombustible board 63, preferably made of silicate and gypsum. The ends of the board incorporates intumescent tapes 64. External mouldings or joint coverings having three internal mortises incorporate intumescent tapes 64. Wooden strips or plates 66 act as protectors for the intumescent tapes 64.

The door 61 is formed by a series of inner bodies forming a board 71 formed by a panel, and a resinous structural wooden support. This portion of the board 71 is coated, and acting as a structural wooden support on its major faces, by two steel plates 74, which configure an armor, which is, in turn, externally coated with incombustible boards 63 on sides. The ends of the major boards having intumescent tapes 69, similar to intumescent tapes 64, but of smaller size.

On the sides of the center structure, there is provided two lengthened pieces forming an external frame 67, constituting a wooden support having a resinous characteristic. In the external board, and on its major faces, two mortises incorporate intumescent tapes 69, and being coated, on the door sides, by a wooden plate strip or board 70, acting as a protector for the intumescent tape. Following the door area, and externally coating the incombustible board 63, there is incorporated a fire-resistant board 73 externally coated with a wooden plate 68 of natural or synthetic material. This second embodiment can include mouldings 74, having two mortises in which intumescent tapes 64 can be internally incorporated, and externally incorporated in the board, having wooden strips or plates 66, as protection of the intumescent tape.

This embodiment is formed from a panel or leaf comprising a wooden board fully insulated from the exterior by means of incombustible material plates, and these by both fire-resistant boards, which are coated with a decorative plate, adequately treated, and presenting a perimetric edge of resinous or abundant conventional wood, on which intumescent tapes are incorporated. One of the intumescent tapes is coplanar to the outer surface of the field, and other housed within said edge. Intumescent tapes located between the inner part of the edge and the rims of the incombustible plates. A continuous wooden plate is arranged on the edge of the door leaf includes protecting the external intumescent tape.

The invention includes on a conventional wooden core including incombustible and intumescent plates. This zone is the center area or core of the door, independent of the existence of a frame fitted with similar characteristics to the door. A joint covering and optional mouldings are also fitted with intumescent tapes and protectors.

Also, the invention can include a door configured in a third embodiment. This door 81 is formed from a wooden support 82, formed by five wooden bodies bonded one to another. Between each pair of wood strips or bodies 82, an incombustible board 83, preferably made of silicate and gypsum, on the ends of which there are incorporated intumescent tapes 84. The sides of the intumescent tapes 84 have protecting bodies or parts 86, having three mortises in the upper part, which incorporate intumescent tapes 84 and later coated with strips 86, in order to protect these intumescent tapes 84.

The door 81 is formed by a series of bodies 91, forming the panel and structural support of resinuous or leafy wood, in accordance with the requirements of the door. This zone 91 is coated. This acts as a structural wooden support on its major faces, with two steel plates 94, forming an amour, which, in turn, is coated externally with incombustible boards 83 on the four corners. Intumescent tapes 89 are on the ends of the major boards.

These tapes are similar to the intumescent tapes 84, but of less size.

The sides of the center structure incorporate two lengthened parts forming the external frame 87, forming a wooden support having a resinous or leafy wood. The external board, and part of the internal one, have mortises incorporating intumescent tapes 89. The side external zone is coated with a protecting body 90, while those located on the minor faces of the bodies 87 are externally coated by an outer protecting shell, made of any material considered convenient. This sheet can present any ornamentation. This embodiment can include moulding 95 a mortise in the internal face, which incorporates intumescent tapes 84, later incorporated in the board, wood strips or plates 86 acting as a protection for the intumescent taper 4.

It should be pointed out that, in this embodiment, it is contemplated the incorporation, in the part 82 configuring the frame having a large size and faced with the lateral zone of the door, of a mortise in which an intumescent tape 89 and the corresponding external strip 90 are included.

In a fourth embodiment, the door 101 is formed from a wooden support 102, formed by five wooden bodies or strips bonded one to another. Between the first pair of strips 102, an incombustible board 103, preferably made of a silicate and gypsum, in the ends of which there are intumescent tapes 104, and protecting bodies or mouldings for the intumescent tapes. There is also an incombustible board 104 located between both center bodies. One of them is more thickened in relation to the other one, and includes an incombustible board 103, between the wooden thick body and the external element 102, joint coverings 105, showing the existence of three mortises, in the inner zone of which intumescent tapes 104, covered by strips 106, are incorporated.

The door 101 of this fourth embodiment is formed by a series of internal bodies forming a board 111, forming the panel, and, at the same time, including the resinous or leafy wood structural support. This board zone 111 acts as a structural support made of wood on its major faces, and is coated with two steel plates 114, forming an armour, which, in turn, is coated, on its outer part, by incombustible boards 103 on its four corners. The ends of the major boards 103 have intumescent tapes 109, similar to the intumescent tapes 104, but markedly smaller.

The sides of the center structure incorporate two elongated parts forming an external frame 107 forming the wooden support of a resinous or leafy characteristics. The external body presents four mortises conveniently arranged on the major and minor faces, having different dimensions, intumescent tapes 109. The door is covered by a wooden board or plate 117, acting as a protection for the intumescent tape 109, located on the major external face of the side body 107. Following the door area, and externally covering the incombustible board 103, a fire-resistant board 113, is incorporated. The board is externally covered by a wooden plate 108, made of any material considered as convenient, independently of whether it may be natural or synthetic.

The invention in this embodiment can include on mouldings 115 which have two mortises in which intumescent tapes 104 are internally incorporated. Acting as a protection of the intumescent tape 104 some wooden strips or plates 106 are externally incorporated in the board.

It should be pointed out that the different metallic elements to be incorporated in the invention, like all the elements constituting good heat conduction, will be protected with intumescent tapes or products, also incombustibles or fire-retardants, so that a fire cannot be provoked by a heat transmission.

I claim:

1. An enclosure which is fire resistive for a predetermined period of time comprising:

a floor affixed upon a forging;

walls extending vertically from said floor;

a ceiling connected to said walls, and doors and windows formed in said walls, said floor and said walls and said ceiling and said doors and said windows being made of fire-resistant materials, said floor constituted by a glass wool felt layer of incombustible material, a platform being affixed onto said glass wool felt layer, said platform being composed of several wooden plates glued one to another, said wooden plates having an expansion joint attached thereon, a wooden skirt board attached to an upper side of said wooden plates and said expansion joint, said expansion joint being sandwiched between said walls and said wooden plates.

2. The enclosure of claim 1, said walls being formed of a material selected from the group consisting of plywood and fiber agglomerate, said wall being treated with a fire-retardant material, said wall being decorated on one face, said wall having a first board formed of a material selected from the group consisting of alabaster and fibrosilicate, said wall having a second board affixed to said first board, said second board being formed of an incombustible material of predetermined thickness, said wall having a third board formed of planks glued one to another for a predetermined thickness, said third board being a core of said walls, said third board having a U-shaped projection adjacent said floor.

3. The enclosure of claim 2, said U-shaped projection having a square rod positioned therein, said square rod being affixed to said floor, said rod having an intumescent material therein, said walls having a reversed U-shaped fastener overlying said first, second and third boards, said fastener being formed of a metallic material.

4. The enclosure of claim 2, said first, second and third boards having intumescent materials sandwiched therebetween.

5. The enclosure of claim 1, said ceiling being self-supporting, said ceiling being supported by an exposed strip formed of a material selected from the group consisting of a noble wood, an agglomerate and fibers, said strip being covered with a sheet, said strip having a groove into which a polygonal box is supported, said box having a thermally and acoustically insulating glass felt material, said box having intumescent tape through a perimeter of said box and along upper and lower edges of said box, said boxes being affixed to said exposed strip upon a neoprone gasket.

6. The enclosure of claim 5, said exposed strip having a balancing strip glued thereon, said balancing strip being glued to a third strip so as to form a reverse "T"-shaped configuration with said exposed strip, said third strip receiving a screw at an upper side thereof.

7. The enclosure of claim 1, each of said doors comprising a panel having a wood board having an incombustible material plate on an exterior surface thereof, said incombustible material plates having a fire-retardant element extending thereover, said panel having a perimeter edge formed of wood and having intumescent tapes affixed therein, one of said intumescent tapes being coplanar to an external edge surface of said panel, another of said intumescent tapes being housed interior of said edge surface, said intumescent tapes being located between an inner portion of said edge surface on a rim of said incombustible plates, said door comprising a leaf having a rim of a continuous plate formed of wood.

8. The enclosure of claim 1, each of said doors having a frame formed with a wooden core having an incombustible plate thereof and intumescent tapes therearound.

9. The enclosure of claim 1, each of said doors comprising a frame having four wooden supports arranged two by two, said frame having an incombustible board having an intumescent tapes at ends thereof, said frame having a joint cover attached to said incombustible board.

10. The enclosure of claim 1, each of said doors comprising a frame fitted with a lateral wood support formed by two coupled bodies, said frame having an external board with two mortises thereon, an intumescent tape being incorporated between said two mortises, said mortises being covered by a wooden sheet so as to cover said intumescent tape.

* * * * *